US008015837B2

(12) United States Patent
Kim

(10) Patent No.: US 8,015,837 B2
(45) Date of Patent: Sep. 13, 2011

(54) ICE BANK OF REFRIGERATOR

(75) Inventor: Joo-Hyun Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 394 days.

(21) Appl. No.: 12/233,341

(22) Filed: Sep. 18, 2008

(65) Prior Publication Data

US 2009/0077993 A1 Mar. 26, 2009

(30) Foreign Application Priority Data

Sep. 20, 2007 (KR) ..... 10-2007-0096147

(51) Int. Cl.
*F25C 5/18* (2006.01)

(52) U.S. Cl. ..... 62/344

(58) Field of Classification Search ..... 62/344; 220/605, 606, 608
See application file for complete search history.

(56) References Cited

U.S. PATENT DOCUMENTS

| | | | | |
|---|---|---|---|---|
| 3,514,964 | A * | 6/1970 | Dodge et al. | 62/137 |
| 3,902,331 | A * | 9/1975 | True et al. | 62/137 |
| 4,641,763 | A * | 2/1987 | Landers et al. | 222/129.1 |
| 5,240,150 | A * | 8/1993 | Palmon | 222/216 |
| 6,176,099 | B1 * | 1/2001 | Hynes | 62/344 |

FOREIGN PATENT DOCUMENTS

KR 10-2006-0110548 A 10/2006

* cited by examiner

*Primary Examiner* — Melvin Jones
(74) *Attorney, Agent, or Firm* — Birch, Stewart, Kolasch & Birch, LLP

(57) ABSTRACT

Disclosed is an ice bank of a refrigerator comprising: a casing for storing ice pieces introduced through one side of an upper surface thereof, and a guide unit formed at one side of the casing so as to guide the introduced ice pieces to be stored in the casing with being uniformly distributed therein. According to the ice bank of the refrigerator the present invention, the ice pieces can be uniformly heaped in the ice bank. Accordingly, it is capable of preventing the ice pieces from overflowing resulting from that the ice pieces are heaped up around a spot where the ice pieces fall down in the ice bank and of facilitatingly containing the ice pieces in the ice bank.

6 Claims, 5 Drawing Sheets

ICE BANK OF REFRIGERATOR

RELATED APPLICATION

The present disclosure relates to subject matter contained in priority Korean Application No. 10-2007-0096147, filed on, Sep. 20, 2007, which is herein expressly incorporated by reference in its entirety.

BACKGROUND OF THE INVENTION

1. Field of the Invention

The present invention relates to an ice bank of a refrigerator, and particularly, to an ice bank of a refrigerator which is capable of preventing ice pieces from overflowing resulting from that the ice pieces are partially over-heaped up in the ice bank.

2. Background of the Invention

A refrigerator serves to store foods to be fresh in a chilling manner or a freezing manner. The refrigerator may be provided with an ice maker for making ice pieces and an ice bank for containing the ice pieces made in the ice maker therein.

Currently, the refrigerators provided with the ice maker and the ice bank increase according to demand for such refrigerator. In such refrigerator, ice pieces made in the ice maker fall down into the ice bank and then heaped up therein.

However, in the ice bank of the conventional refrigerator, the ice pieces falling down from the ice maker is concentratingly heaped up around a spot where the ice pieces fall down. Accordingly, empty portions may be generated in the ice bank, while the ice pieces may be over-heaped up on the falling spot of the ice pieces.

If the ice pieces are partially over-heaped up in the ice bank as the ice pieces are non-uniformly heaped up therein, the over-heaped ice pieces may fall down onto a bottom of a freezing chamber when a door is opened/closed. And, this phenomenon may cause the refrigerator to be partially unclean or unsanitary by the fallen ice pieces and cause damage to a part of the refrigerator or a user's body. Also, user's satisfaction on the product may be deteriorated.

SUMMARY OF THE INVENTION

Therefore, an object of the present invention is to provide an ice bank of a refrigerator which is capable of preventing ice pieces from overflowing resulting from that the ice pieces are partially over-heaped up in the ice bank, by allowing the ice pieces introduced into the ice bank to be uniformly heaped up therein.

To achieve these and other advantages and in accordance with the purpose of the present invention, as embodied and broadly described herein, there is provided an ice bank of a refrigerator comprising a casing for storing ice pieces introduced through one side of an upper surface thereof and a guide unit formed at one side of the casing so as to guide the introduced ice pieces to be stored in the casing with being uniformly distributed therein.

The guide unit may serve to prevent the introduced ice pieces from being concentratingly stored at one side of an inner space of the casing.

The guide unit may be formed to be downwardly inclined from one side of a bottom surface of the casing to another side thereof in correspondence with an introduction direction of the ice pieces.

The guide unit may be implemented as one of an inclined surface and a curved surface.

The guide unit may be implemented as the bottom surface of the casing, the bottom surface formed to be inclined.

The guide unit may be implemented as a separate member in the casing.

And, the guide unit introduced into the ice bank may be made in an ice maker and then fall down, and serve to guide the ice pieces from fallen spot thereof to other portions so that the ice pieces can be uniformly distributed in the ice bank.

Meanwhile, in accordance with another aspect of the present invention, there is provided an ice bank of a refrigerator comprising a casing for storing ice pieces introduced through one side of an upper surface thereof a discharge hole formed at one side of the casing so as to discharge the stored ice pieces therethrough, a transfer portion for transferring the ice pieces to the discharge hole and a guide unit formed at an inner one side of the casing so as to guide the introduced ice pieces to be stored in the casing with being uniformly distributed therein.

The guide unit may be formed to be protruded from an inner surface of the casing so as to be located on a path through which the introduced ice pieces fall down.

The guide unit may be protrudingly formed to be downwardly inclined from the inner surface of the casing.

The guide unit may be implemented as a cantilever elastically transformed by the falling ice pieces.

The guide unit may comprise a first guide portion protruded from the inner surface of the casing so as to be located on the path through which the introduced ice pieces fall down and a second guide portion inclinedly formed on a bottom surface of the casing so as to guide the ice pieces having a path changed by the first guide portion toward a lower side of the first guide portion.

According to the ice bank of the refrigerator in accordance with the present invention, by the guide unit, the ice pieces falling down into the ice bank may not be heaped up around a falling spot of the ice pieces in the ice bank but be moved along the guide unit. Accordingly, the fallen ice pieces can be uniformly heaped in the inner space of the casing of the ice bank. Therefore, it is capable of preventing the ice pieces from being heaped up around the spot where the ice pieces fall down in the ice bank and of facilitatingly containing the ice pieces in the ice bank.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Figure 1:
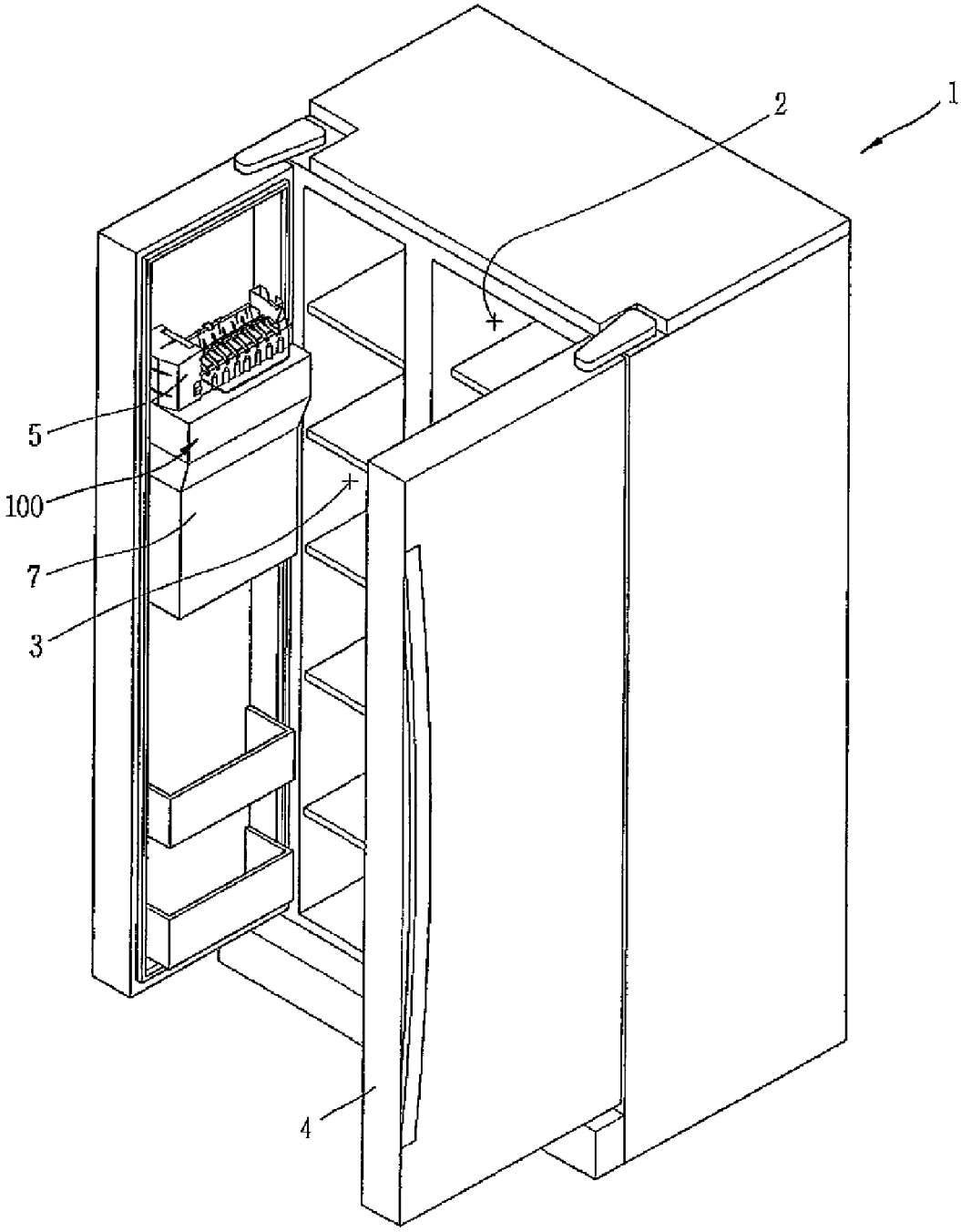
FIG. 1 is a perspective view showing a refrigerator having an ice bank in accordance with a first exemplary embodiment of the present invention.

FIG. 1 is a perspective view showing a refrigerator having an ice bank in accordance with a first exemplary embodiment of the present invention.

Referring to FIG. 1, a refrigerator 1, as an appliance for storing foods, includes a cooling chamber 2 in which foods are stored in a chilling manner at a temperature above zero degree, a freezing chamber 3 in which foods including ice pieces are stored at a temperature below zero degree, an ice maker 5 received in the freezing chamber 3 so as to make ice pieces and an ice bank 100 in which the ice pieces made in the ice maker 5 are stored up. The cooling chamber 2 and the freezing chamber 3 are selectively opened or closed by doors 4.

And, an ice piece dispenser 7 may be further provided so that the ice pieces stored in the ice bank 100 can be properly supplied when a user desires.

The refrigerator 1 is provided with components for implementing a refrigeration cycle, such as a compressor, a condenser, an expander and an evaporator.

Operation related to the ice maker 5 will be explained.

After water is moderately supplied to the ice maker 5, cooling air is supplied to the ice maker 5. And then, after ice pieces are made in the ice maker 5 by the supplied cooling air, the ice pieces are separated from the ice maker 5 by an operation of the ice maker 5 itself and then fall down into the ice bank 100.

And then, the ice pieces stored in the ice bank 100 are supplied to the user whenever he/she wants as much as he/she wants by opening the door 4 so as to draw out the ice pieces or through the ice piece dispenser 7 according to the user's requirement.

In case of the latter, an ice piece crusher for crushing the ice pieces into slush type ones is further provided in the ice bank 100, and an additional transfer portion for supplying the ice pieces into the ice piece crusher may be further provided.

Figure 2:
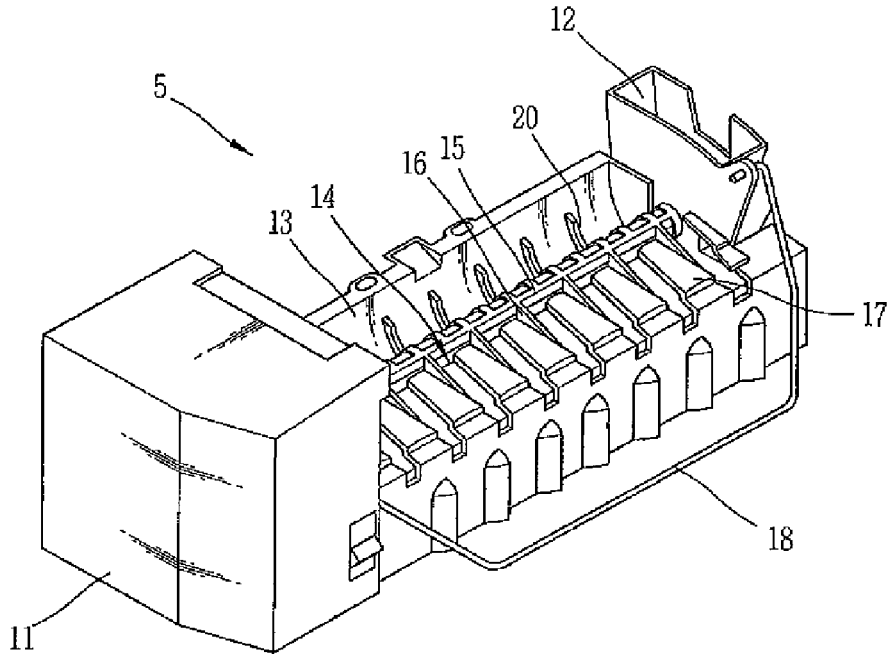
FIG. 2 is a perspective view showing an ice maker in accordance with the first exemplary embodiment of the present invention.

FIG. 2 is a perspective view showing an ice maker in accordance with the first exemplary embodiment of the present invention.

Referring to FIG. 2, the ice maker 5, serving to make ice pieces, includes a water supply unit 12 to which water is supplied from outside, an ice making chamber 13 in which ice pieces are made, an ejector 14 through which the ice pieces made in the ice making chamber 13 are ejected, a control box 11 in which multiple components allowing the ejector 14 to be rotated are mounted and an ice level sensing lever 18 for sensing whether or not the ice bank 100 is completely filled with the ice pieces so as to control the ice maker 5. Meanwhile, a coupling unit (not shown) by which the ice maker 5 is mounted in the refrigerator and coupled thereto is formed at a rear side of the ice making chamber 13.

In detail, the ejector 14 includes a shaft 15 rotated by being extended toward the outside of the control box 11 and an extended portion 16 for drawing up the ice pieces by rotation of the shaft 15 by being extended toward the outside of the shaft 15.

And, the ice making chamber 13 is partitioned into a plurality of small spaces by partitioning protrusions 20 so as to form the ice pieces to have a proper size. And, a separator 17 for guiding the ice pieces drawn up by the ejector 14 to fall down into the ice bank 100 is formed at an upper side of the ice making chamber 13. And, a heater (not shown) applying heat is disposed at a lower side of the ice making chamber 13 so as to detach the ice pieces from contact surfaces of an inner side surface of the ice making chamber 13.

Referring to the configuration, operation of the ice maker 5 will be explained.

Water having guided by a water supply pipe formed in a specific shape is supplied to the water supply unit 12. The supplied water is introduced into the ice making chamber 13 and then contained in each space partitioned by partitioning protrusions 20. And then, cooling air of below zero degree is supplied toward the water and thus the water contained in the ice making chamber 13 is frozen.

When the water in the ice making chamber 13 is completely frozen through this process, the ejector 14 is operated by a specific driving mechanism disposed in the control box 11. In detail, the shaft 15 is rotated, and accordingly the extended portion 16 is also rotated. Accordingly, the ice pieces made in the ice making chamber 13 are drawn up along an inner circumferential surface of the ice making chamber 13. Before the ejector 14 is operated, heat is applied by the heater 21 so that the ice pieces can be detached from the contact surfaces of the ice making chamber 13.

After the ice pieces are drawn up by the ejector 14, the ice pieces are guided by the separator 17 and then fall down into the ice bank 100 to be stored up.

The aforementioned operation is repeatedly executed. While the operation is repeatedly executed, the ice level sensing lever 18 senses whether or not the ice pieces are stored in the ice bank 100 by a pre-set level. If it is sensed that the ice pieces are contained in the ice bank 100 by the pre-set level, the ice maker 5 may stop operating.

Figure 3:
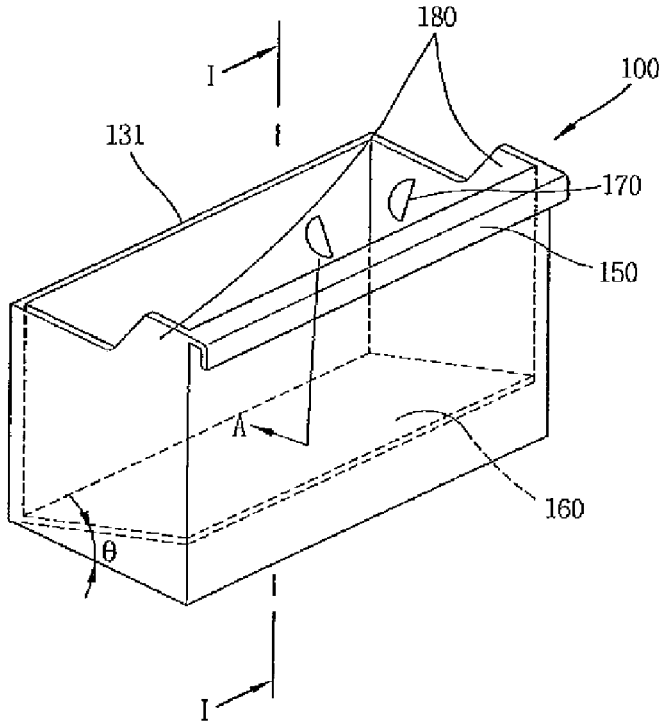
FIG. 3 is a perspective view showing an ice bank in accordance with the first exemplary embodiment of the present invention.
Figure 4:
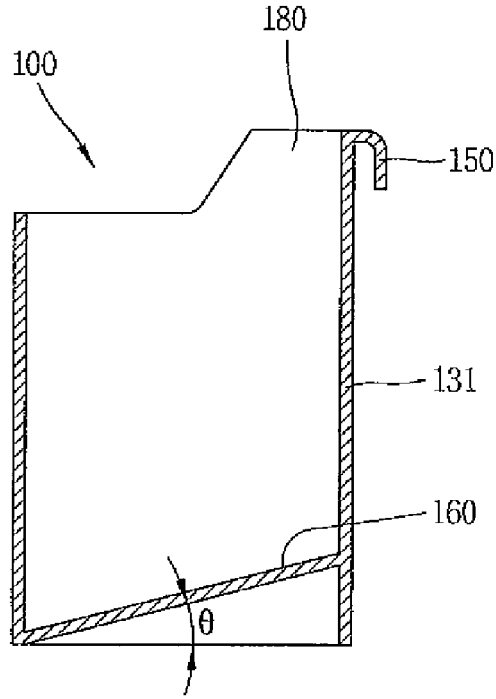
FIG. 4 is a section view taken along line 'I-I' in FIG. 3.

FIG. 3 is a perspective view showing an ice bank in accordance with the first exemplary embodiment of the present invention, and FIG. 4 is a section view taken along line 'I-I' in FIG. 3.

Referring to FIGS. 3 and 4, the ice bank 100 in accordance with this embodiment includes a casing 131 formed in an integral bucket structure, in which an ice piece storage chamber is formed, and a guide unit 160 for guiding the ice pieces so that the ice pieces fallen from the ice maker 5 can be stored with being uniformly distributed in the casing 131.

In the guide unit 160, a bottom portion where the ice pieces made in the ice maker 5 fall down and collide against is formed to be higher than other bottom portions of the casing 131.

That is, the guide unit 160 is configured to have a bottom surface of the casing 131 downwardly inclined from one side to another side in correspondence with an introduction direction of the ice pieces, preferably.

Accordingly, it is capable of preventing the ice pieces introduced from the ice maker 5 and stored in the casing 131 from being concentratingly stored in one portion of the inner space of the casing 131, in the guide unit 160.

Meanwhile, in this embodiment, one side surface of the casing 131 may be provided with a handle portion 150 so that the user can conveniently move the casing 131 or receive the casing 131 at the lower portion of the ice maker 5.

And, it may be configured to have the entirely same height of upper ends of side surfaces of the casing 131 forming an opened upper surface of the casing 131 through which the ice pieces are introduced from the ice maker 5. However, preferably, an upper end of a side surface of the casing 131 corresponding to a direction for discharging the ice pieces from the ice maker 5 is configured to be higher than other upper ends of other side surfaces thereof.

Accordingly, reduced is a distance between a spot where the ice pieces are discharged from the ice maker 5 to a spot where the ice pieces are introduced into the casing 131. Accordingly, it is capable of reducing a phenomenon that the ice pieces discharged from the ice maker 5 is not supplied into the casing 131 but outwardly fall down due to an error occurring during the operation of the ice maker 5.

Hereafter, operation of the ice bank in accordance with this embodiment will be explained.

In this embodiment, the ice bank 100 has the lower portion provided with the guide unit 160.

That is, the guide portion 160 is implemented as an inclined surface having a specific angle at a portion of the lower portion of the casing 131, the portion where the ice pieces fall down from the ice maker 5. The inclined surface is configured to have a portion where the ice pieces fall down formed to be higher than other portions of the casing 131.

Upon forming the inclined surface, the ice pieces falling down into the ice bank 100 from the ice maker 5 can not be heaped up around a spot where the ice pieces fall down in the ice bank 100 but be moved along the inclined surface 160.

Accordingly, the ice pieces can be uniformly heaped up in the ice bank 100. Thus, it is capable of preventing a phenomenon that the ice pieces are heaped up around the spot where the ice pieces fall down and thus the ice pieces overflow in the ice bank 100, and of facilitatingly containing the ice pieces in the ice bank 100.

Hereafter, another embodiment of the present invention will be explained. A configuration and description same as that of the first embodiment will be omitted.

Figure 5:
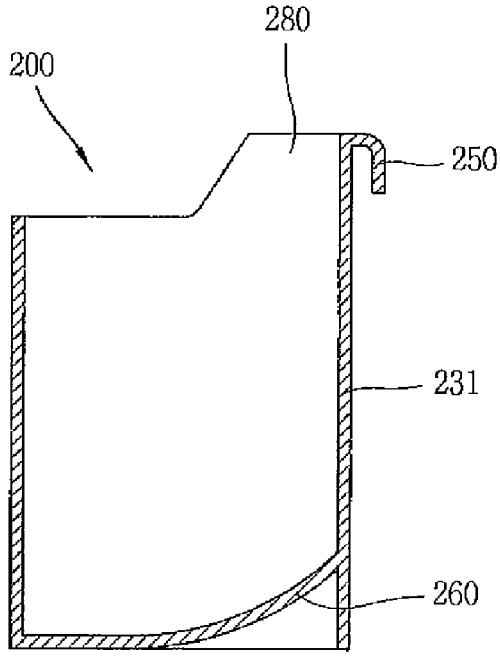
FIG. 5 is a vertical section view showing a casing of an ice bank in accordance with a second exemplary embodiment of the present invention.

FIG. 5 is a vertical section view showing a casing of an ice bank in accordance with a second exemplary embodiment of the present invention.

Referring to FIG. 5, a guide unit 261 implemented as a curved surface having a specific curvature is formed at a spot where ice pieces fall down in a casing 231 of an ice bank 200. In the curved surface, a surface where the ice pieces fall down is a higher than other surfaces, preferably.

Hereafter, still another embodiment of the present invention will be explained. A configuration and description same as that of the first embodiment will be omitted.

Figure 6:
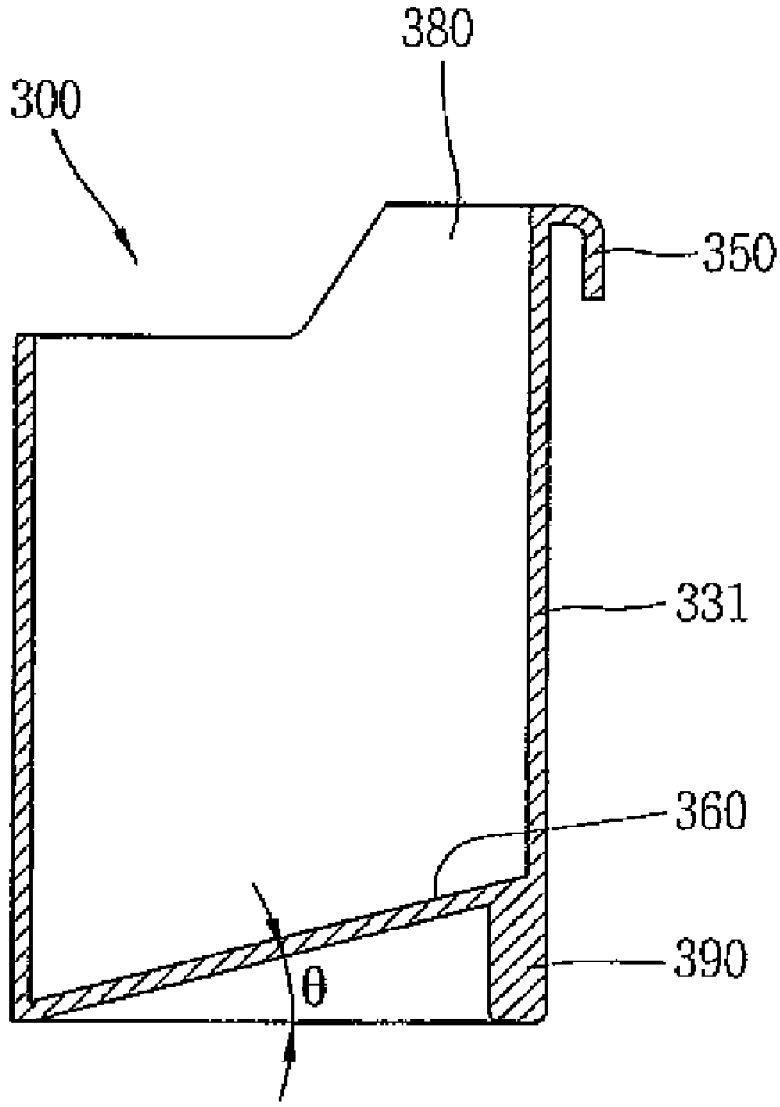
FIG. 6 is a vertical section view showing a casing of an ice bank in accordance with a third exemplary embodiment of the present invention.

FIG. 6 is a vertical section view showing a casing of an ice bank in accordance with a third exemplary embodiment of the present invention.

Referring to FIG. 6, in this embodiment, a casing 331 of an ice bank 300 have an inclined bottom surface 360. And, a horizontal state maintaining portion 390 is provided at a specific position of the lower portion of the bottom surface 360 so as to maintain a horizontal state of the ice bank 300.

Accordingly, it is capable of reducing problems such as increase of used materials and difficulty in fabrication caused by additionally installing the guide unit formed at the bottom surface of the casing 331 and in the casing 331.

Hereafter, yet still another embodiment of the present invention will be explained. A configuration and description same as that of the first embodiment will be omitted.

Figure 7:
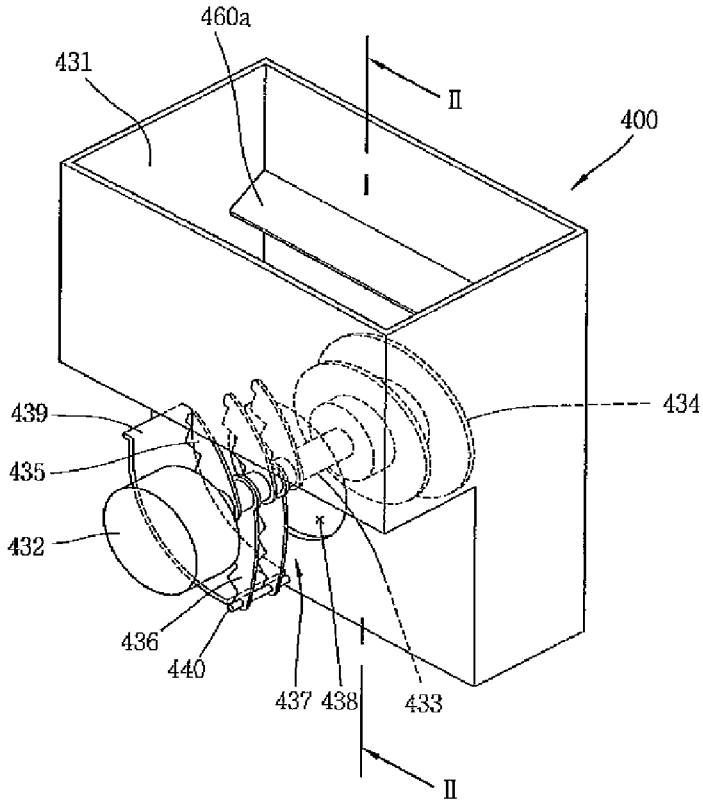
FIG. 7 is a perspective view showing a casing of an ice bank in accordance with a fourth exemplary embodiment of the present invention.
Figure 8:
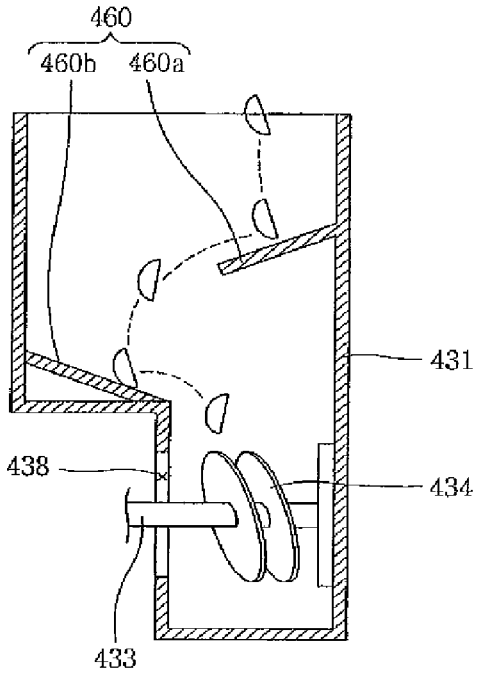
FIG. 8 is a section view taken along line 'II-II' in FIG. 7.

FIG. 7 is a perspective view showing a casing of an ice bank in accordance with a fourth exemplary embodiment of the present invention, and FIG. 8 is a section view taken along line 'II-II' in FIG. 7.

Referring to FIGS. 7 and 8, an ice bank 400 in this embodiment is partitioned from an external space by an integral type casing 431, and stores ice pieces therein. And, an ice piece transfer portion 434 is disposed at an inner side surface of a lower portion of the casing 431 and an ice piece crusher 437 for crushing the transferred ice pieces is disposed at an outer side surface of the lower portion thereof. The ice piece transfer portion 434 and the ice piece crusher 437 are supported by a same rotation shaft 433. The ice piece crusher 437 is provided with a fixed blade 436 and a rotating blade 435 so as to allow the ice pieces to be crushed into proper-sized ice pieces. The ice pieces supplied from the ice bank 400 is supplied to the ice piece crusher 437 through a discharge hole 438 and then supplied to an ice piece dispenser disposed at the outside of the refrigerator. Through this process, the user can obtain the ice pieces.

Here, the ice bank 400 includes the casing 431 which the ice pieces are introduced into and stored in, the discharge hole 438 through which the stored ice pieces are drawn out, the transfer portion 434 for transferring the ice pieces to the discharge hole 438 and a guide unit 460 for guiding the introduced ice pieces so so that the ice pieces can be uniformly distributed and stored in the casing 431.

Here, the guide unit 460 is disposed on a path through which the introduced ice pieces fall down and formed to be protruded to be downwardly inclined from the inner surface of the casing 431.

Thus, the fallen ice pieces collide with the guide unit 460 and thus the falling path of the ice pieces are changed. Accordingly, it is capable of preventing the ice pieces from being stored with being concentratingly heaped up at one portion in an inner space of the casing 431.

Preferably, the guide unit 460 includes a first guide portion 460*a* protruded from the inner surface of the casing 431 so as to allow the introduced ice pieces to be located on the path through which the introduced ice pieces fall down, and a second guide portion 460*b* inclinedly formed on the bottom surface of the casing 431 so as to guide the ice pieces having a path changed by the first guide portion 460*a* toward a lower side of the first guide portion 460*a*.

Accordingly, the ice pieces introduced into the ice bank 400 collide against the first guide portion 460*a* and the second guide portion 460*b* and then introduced toward the transfer portion 434. When the great deal of ice pieces are stored at a side of the transfer portion 434 as time elapses, that is, the ice pieces supplied after a height of the stored ice pieces is greater than that of an installation position of the second guide portion 460*b* are stored below the first guide portion 460*b* and above the second guide portion 460*b*.

Thus, it is capable of preventing the ice pieces introduced from the ice maker 5 from concentratingly stored at a position where the transfer portion 434 is located.

Hereafter, in the ice bank 400 in accordance with this embodiment, the transfer portion 434, the discharge hole 438 and the ice piece crusher 437 for adjusting the size of the ice pieces discharged through the ice piece dispenser will be explained in detail.

The transfer portion 434 serves to smoothly transfer the ice pieces stored in the casing 431 toward the ice piece crusher 437.

The transfer portion 434 may be implemented as an auger formed in a spiral shape.

The ice piece crusher 437 includes the fixed blade 436 fixed with respect to the casing 431, the rotating blade 435 rotated with respect to the fixed blade 436, the rotation shaft 433 into which the rotating blade 435 is inserted so as to transfer a rotation force and a motor 432 connected to one end portion of the rotation shaft 433.

The operation of the ice piece crusher 437 depends on a mode determined by the user.

First, in a case of a mode requiring to discharge the ice pieces stored in the casing 431 without a crushing process, if the ice pieces stored in the casing 431 are transferred toward the ice piece crusher 437 through the discharge hole 438 by the rotation of the transfer portion 434, the ice pieces may be discharged to the ice piece dispenser by the rotation of the rotating blade 435. That is, the ice piece crusher 437 and the ice piece dispenser are controlled under a state that they are communicated with each other.

On the other hand, in a case of a mode requiring to discharge the ice pieces stored in the casing after crushing them, if the ice pieces stored in the casing 431 are transferred toward the ice piece crusher 437 through the discharge hole 438 by the rotation of the transfer portion 434, the ice pieces may be guided between the rotating blade 435 and the fixed blade 436 and then crushed by a pushing operation of the rotating blade 435. In this case, the ice piece crusher 437 and the ice piece dispenser are controlled under a state that they are not communicated with each other by an additional member. Thus, the ice pieces are always interposed between the rotating blade 435 and the fixed blade 436, and accordingly the crushing process is continued.

Thereafter, when the crushing process is finished, as the ice piece crusher 437 and the ice piece dispenser are controlled to be communicated with each other, the crushed slush ice is outwardly discharged through the ice piece dispenser.

Here, a function for selectively communicating the ice piece crusher 437 and the ice piece dispenser is executed by a shutter 439.

Operation of the ice bank 400 will be explained.

The ice pieces made in the ice maker 5 fall down through an upper side of the casing 431 and then are contained in the ice bank 400. The ice pieces contained in the ice bank 400 are supplied when the user wants in a proper size with the proper amount. To this end, upon operating the motor 432, the rotation shaft 433 is rotated and thus the transfer portion 434 is operated. Then, the ice pieces are transferred. The transferred ice pieces are selectively crushed by the ice piece crusher 437 and then discharged through the ice piece dispenser in an ice piece type or a crushed slush ice type.

And, the ice piece crusher 437 can be operated as a transfer mechanism, as well as the transfer portion 434 for transferring the ice pieces to the ice piece crusher 437, because the ice piece crusher 437 comes into contact with the ice pieces. In detail, since the rotating blade 435 comes in contact with the ice pieces when the rotating blade 435 starts to rotate, the ice pieces may be crushed by interaction with the fixed blade 436 or be transferred by the rotation of the rotating blade 435.

And, it may be controlled whether or not the ice pieces or slush ice is discharged through the ice piece dispenser by operation of the shutter 439.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An ice bank of a refrigerator comprising:

a casing having a first section for introducing ice pieces into the casing, a second section for storing ice pieces which are transferred from the first section, and a third section for transferring ice pieces which are stored in the second section;

a discharge hole formed at one side of the casing so as to discharge the stored ice pieces therethrough;

a transfer portion disposed in the third section of the casing, for transferring the ice pieces to the discharge hole; and a guide unit formed at an inner surface of the casing so as to guide the introduced ice pieces, wherein the guide unit comprises:

a first guide portion protruded from one side of an inner surface of the casing so as to be located on the path through which the introduced ice pieces fall down, and downwardly inclined toward the second section so as to guide the ice pieces to the second section; and a second guide portion formed on another side of the inner surface of the casing so as to guide to the third section the ice pieces having a path changed by the first guide portion, and downwardly inclined toward the third section so as to guide the ice pieces to the third section.

2. The ice bank of claim 1, wherein the guide unit is implemented as a cantilever elastically transformed by the falling ice pieces.

3. The ice bank of claim 1, wherein the first guide portion and the second guide portion are located above the transfer portion.

4. The ice bank of claim 1, wherein the one side of the inner surface of the casing including the first guide portion is located opposite to the another side of the inner surface of the casing including the second guide portion.

5. The ice bank of claim 1, wherein the casing includes a bottom member located below the transfer portion.

6. The ice bank of claim 1, wherein the one side of the inner surface of the casing including the first guide portion is located opposite to the one side of the casing including the discharge hole.

* * * * *